United States Patent [19]

Kingswell

[11] 4,053,960

[45] Oct. 18, 1977

[54] BACK SCRUBBER

[76] Inventor: Henry Kingswell, 64 Samba Drive, Weston, Ontario, Canada, M9M 2N1

[21] Appl. No.: 667,714

[22] Filed: Mar. 17, 1976

[51] Int. Cl.[2] ..... A47K 7/03

[52] U.S. Cl. ..... 15/104.92; 4/184; 401/198

[58] Field of Search ..... 15/104.92, 244 B, 244 C; 4/158, 184; 128/65; 248/206 A; 401/42, 201, 198

[56] References Cited

U.S. PATENT DOCUMENTS

| | | | |
|---|---|---|---|
| 559,434 | 5/1896 | Bloe | 4/184 |
| 843,260 | 2/1907 | Cloud | 4/158 |
| 1,489,862 | 4/1924 | Toy | 401/42 |
| 2,736,913 | 3/1956 | Mirth | 401/201 X |
| 3,040,337 | 6/1962 | Fjelstad | 4/184 |
| 3,199,139 | 8/1965 | Vallis | 401/201 |
| 3,209,372 | 10/1965 | Boyett et al. | 4/158 |
| 3,478,369 | 11/1969 | Ensley | 4/158 |

*Primary Examiner*—Daniel Blum

[57] ABSTRACT

An improved back scrubber device adapted to be removably secured to a wall. The scrubber includes a base portion including a plurality of suction devices adapted to removably secure the base portion to the wall and a cover adapted to enclose an opening on the base portion. The cover includes a porous portion which is adapted to permit the passage therethrough of a soap and water solution upon the introduction of external pressure against the cover in a direction toward the back of the base portion. An access opening is provided on one of the side walls for the introduction of a soap and water solution to the base portion. A drying element and means for securing the drying element to the base portion and cover are further provided.

3 Claims, 4 Drawing Figures

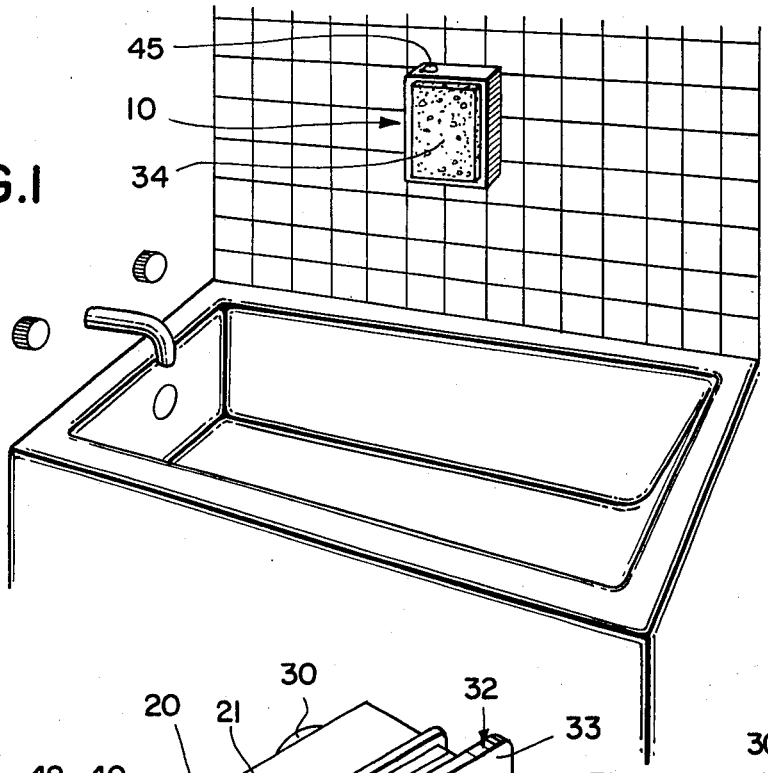
FIG.1
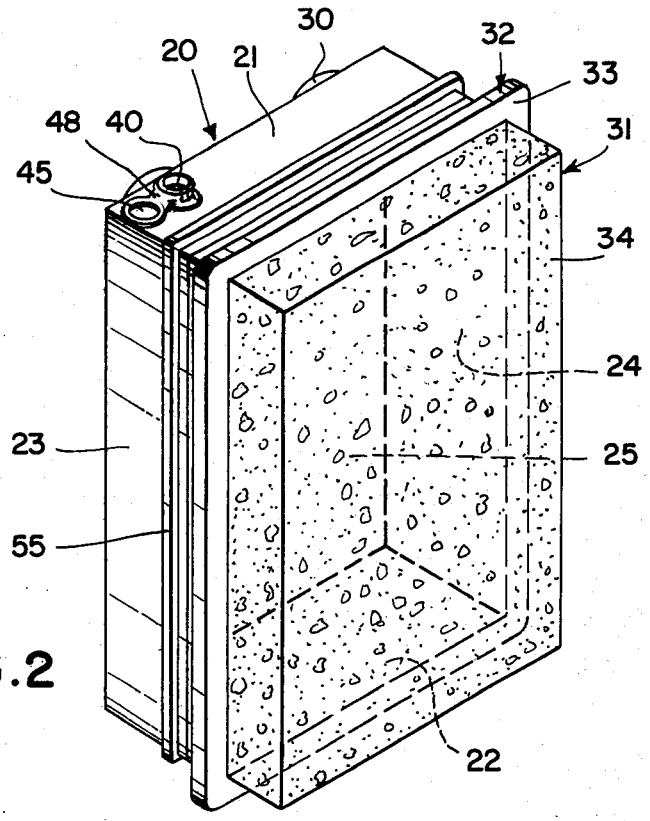
FIG.2
FIG.3
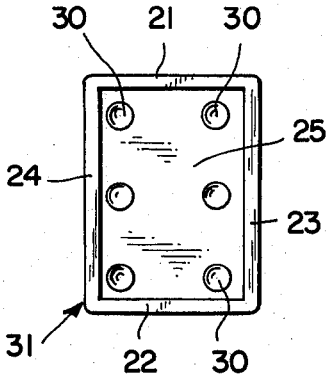
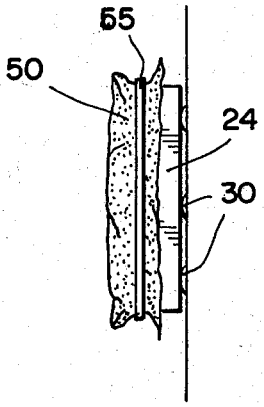
FIG.4

BACK SCRUBBER

BACKGROUND OF THE INVENTION

The present invention relates generally to a back scrubber and, more particularly, to a back scrubber which may be removably secured to a bathroom or shower stall wall for use in cleaning and drying one's back.

The back scrubber of the present invention is particularly suitable for use in home and hotel bathrooms and shower stalls for the cleansing and drying of one's back during and after bathing. It will, of course, be appreciated that the average individual is unable to reach certain parts of their back without mechanical assistance. This mobility is particularly acute in those people suffering from arthritis and obesity. The handheld back brush is a common implement employed to accomplish this goal. Additionally, wall mounted back scrubbers have also been used in the past to effect the same result. These back scrubbers are generally attached to a shower or bath wall and are designed to have a person rub his or her back against them. Examples of such prior art back scrubbers are the devices described in U.S. Pat. Nos.: 3,750,226; 3,612,044; 3,577,985; 3,040,337 and 2,904,038.

Generally, these prior art back scrubbers required prior sudsing of the exterior surface of the scrubber before use. Additionally, these back scrubbers did not permit easy interchange of the scrubber element for use by different members of the family nor did they provide the added feature of an easily mounted drying element so that, after bathing, one might be able to use the same back scrubber as a back drier.

Against the foregoing background, it is a primary objective of the present invention to provide an improved back scrubber adapted to be removably secured to a bathroom or shower stall wall.

It is another object of the present invention to provide a back scrubber which is self-soaping.

It is still another object of the present invention to provide a back scrubber which includes easily mounted scrubber and drying elements.

SUMMARY OF THE INVENTION

To the accomplishment of the foregoing objects and advantages, the present invention briefly comprises a back scrubber including a base portion and a cover. The base portion is comprised of a back and a plurality of side walls extending from the back to define an opening disposed remotely from the back. Suction means are provided to removably secure the base portion to a wall. The cover, which includes a porous portion, is adapted to be removably mounted on the base portion to enclose the opening on said base portion disposed remotely from the back. The porous portion is adapted to, upon the introduction of pressure against the cover in the direction toward said back, permit the passage therethrough of a soap and water solution contained within the base portion. An access opening is provided on one of the side walls for the introduction of the soap and water solution to the base portion. A drying element is similarly provided for placement over the cover. The drying element is removably secured to the base portion by means of an elastomeric band.

BRIEF DESCRIPTION OF THE DRAWINGS

The foregoing and still other objects and advantages of the present invention will be more apparent from the following detailed explanation of the invention in correction with the accompanying drawings, wherein:

FIG. 1 illustrates in partial perspective view a bath tub enclosure including on one of its walls the back scrubber device of the present invention;

FIG. 2 is an enlarged perspective view of the back scrubber of the present invention;

FIG. 3 is a back view of the back scrubber of FIG. 2;

FIG. 4 is a side view of the back scrubber of the present invention including a drying element.

DESCRIPTION OF THE PREFERRED EMBODIMENTS

Referring now to the drawings and, in particular, to FIG. 1 there is shown the back scrubber of the present invention referred to generally by reference numeral 10 as it is mounted on an inner bath wall for easy access during bathing.

The construction of the back scrubber 10 is best shown in FIGS. 2 and 3. As illustrated, the back scrubber is comprised of an open ended enclosure 20 and a cover 31. The open ended enclosure 20, preferably formed from a theroplastic material such as, for example, polypropylene, includes a top and bottom wall 21 and 22 respectively, and side walls 23 and 24 all molded integral with and extending perpendicular to a back portion 25. The back portion 25 is preferably rectangular in shape.

The open ended enclosure 20 is adapted to be removably secured to an inner bath or show wall by means of a plurality of suction devices 30, preferably a plurality of elastomeric suction cups, which are affixed to the exterior surface of the back portion 25. A preferred number of suction devices is six. It will, of course, be readily appreciated that the inclusion of such suction devices permit ready securing and removal of the open ended enclosure 20 to bath and shower walls.

A cover 31 is provided to be mounted about the open portion of the enclosure 20 in such a manner as to be supported by the walls 21, 22, 23 and 24. The cover 31 includes an open frame 32 to which is affixed a scubbing element 34. The frame 32, preferably molded integrally from a thermoplastic material such as, for example, polypropylene, should be of such a shape and dimension as to, when mounted about the open ended enclosure, form a compression fit about the walls 21, 22, 23 and 24. The scrubbing element 34 is affixed to the outer edge portion 33 of the frame 32 by a water insoluble adhesive or by virtually any conventional affixation means such as, for example, a plurality of clips. The scrubbing element 34 is porous and should posses a somewhat coarse or textured outer surface. A sponge or sponge-like material is preferred. It will be appreciated that when the cover 31 is mounted on the open ended enclosure 20 by a compression fit between the frame 32 and the walls 21, 22, 23 and 24 of the enclosure, it provides a generally sealed enclosure having one porous outer wall which constitutes the scrubbing element 34.

An access opening or port 40 is provided on the top wall 21 of the enclosure 20. Port 40 is of such a size and shape to permit receipt of a soap and water solution which is to be added to the device 10 to render it self soaping. A cap 45 is provided to close the port 40 after introduction of the solution. The cap 45 may be secured to the top wall 21 by a hinge 48.

In order to realize the self-soaping feature of the present invention, the cover 31 is inserted over the open end portion of the open ended enclosure 20. A soap and water solution sufficient to fill the enclosure 20 is then added through the port 40 on the top wall 21. The porous scrubbing element 34, absent the introduction of any pressure from an external source will generally permit an enclosure to retain this soap and water solution. However, upon the introduction of an external pressure in the direction toward the back of the enclosure such as by rubbing of one's back against the scrubbing element, this inward pressure forces a portion of the soap and water solution through the pores of the scrubbing element 34 onto the bather's back thus rendering the back scrubber self-soaping.

The cover 31 may be readily removed and replaced with interchangeable covers 31 for sanitary purposes by sliding the cover 31 away from the enclosure 20.

It is also contemplated that a drying element 50, as shown in FIG. 4 may be added for use after the bathing operation and after the soap and water mixture has been emptied from the enclosure 20 by merely loosening and removing the cover 31. Upon remounting of the cover 31 about the enclosure 20, a drying element 50, preferably a piece of towelling material precut to encase the cover 31, is placed over the cover 31 and secured to the enclosure by means of an elastomeric band 55 which encircles the walls 21, 22, 23 and 24 of the enclosure and which is adapted to securedly affix the edge of the drying element 50 to the walls 21, 22, 23 and 24 of the enclosure 20. One wishing to dry his or her back would then have to merely rub their back against the drying element 50. As with the covers 31, the drying elements 50 can be readily interchanged for sanitary reasons.

Having thus described the invention with particular reference to the preferred forms thereof, it will be obvious that various changes and modfications can be made therein without departing from the spirit and scope of the invention as defined in the appended claim.

I claim:

1. An improved back scrubber device adapted to be removably secured to a wall, said device comprising in combination:

a base portion including a back and four side walls integral with and extending perpendicularly from said back to define an opening remotely disposed from said back:

a plurality of suction type securing devices affixed to the exterior surface of said back, said suction devices adapted to removably secure said base portion to said wall;

a cover including a porous sponge portion affixed to and encircled by an open frame, said cover adapted to be removably mounted on said back portion by a compression fit between the interior surfaces of said frame and the exterior surface of the walls of said base portion to close said opening, said porous portion being of such porosity that it permits the passage therethrough of a soap and water solution introduced into said base portion through an access opening on one of said side walls upon the introduction of external pressure on said porous portion in a direction toward said back but prevents the passage therethrough of said solution in the normal unstressed condition;

a drying element comprising a section of towelling material, and means to secure the drying element to said base portion.

2. The device of claim 1 wherein said suction type securing devices are elastomeric suction cups.

3. The device of claim 1 wherein said means to secure comprises an elastomeric encircling the walls of said base portion, said band securing said piece of towelling material to the walls of said base portion.

* * * * *